US005435556A

United States Patent [19]

Rice et al.

[11] Patent Number: 5,435,556

[45] Date of Patent: Jul. 25, 1995

[54] ELECTRICALLY OPERATED RANDOM NUMBER SELECTOR

[75] Inventors: Richard R. Rice; William D. Rice, both of Hamilton, Canada

[73] Assignee: Win-It Lotto Selections Inc., Hamilton, Canada

[21] Appl. No.: 162,235

[22] Filed: Dec. 6, 1993

[51] Int. Cl.[6] ..... A63F 3/00

[52] U.S. Cl. ..... 273/144 B; 273/138 A; 273/142 E; 273/142 G; 273/145 E

[58] Field of Search ..... 273/138 A, 143, 138 R, 273/144 B, 145 E, 142 R, 142 E, 142 F, 142 G, 153 R

[56] References Cited

U.S. PATENT DOCUMENTS

| | | | |
|---|---|---|---|
| 2,500,830 | 3/1950 | Jones | 273/142 R |
| 4,206,921 | 6/1980 | Lüehr | 273/142 D |
| 4,336,938 | 6/1982 | Laroche | 273/138 R |
| 4,669,728 | 6/1987 | Carden | 273/138 A |
| 4,732,386 | 3/1988 | Rayfiel | 273/142 H |
| 4,809,979 | 3/1989 | Skowronski et al. | 273/153 R |
| 4,906,004 | 3/1990 | Wenzel | 273/138 R |
| 4,941,665 | 7/1990 | Klamer | 273/142 H |
| 5,058,894 | 10/1991 | Levinn et al. | 273/153 R |
| 5,102,138 | 4/1992 | Johnson | 273/144 B |
| 5,197,736 | 3/1993 | Backus et al. | 273/142 R |
| 5,238,440 | 8/1993 | Morin | 273/142 E |

FOREIGN PATENT DOCUMENTS

| | | | |
|---|---|---|---|
| 3717593 | 12/1988 | Germany | 273/144 B |
| 3720813 | 1/1989 | Germany | 273/142 E |
| 0654681 | 2/1986 | Switzerland | 273/144 B |
| 2234183 | 1/1991 | United Kingdom | 273/142 E |

*Primary Examiner*—Raleigh W. Chiu

[57] ABSTRACT

An electrically operated random number selector has a main housing with top and bottom walls. A number selection turntable assembly is mounted at the top wall of the housing which contains a power source for rotating the turntable assembly and a power control member at the bottom wall of the housing. When the selector is resting on a support surface the power control member is held in a power off position at the bottom wall of the housing and when the selector is lifted off of the support surface, the power control member is automatically movable to a power on position extending downwardly from the bottom wall of the selector.

5 Claims, 3 Drawing Sheets

FIG. 1.
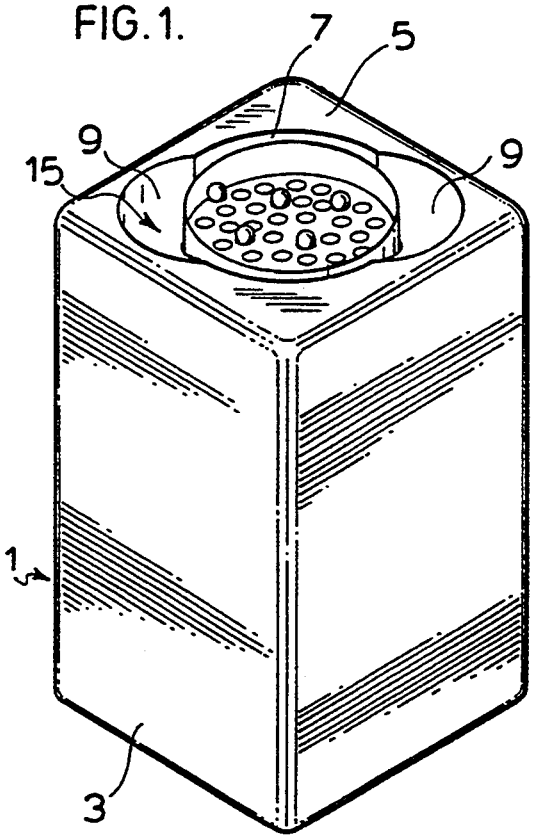
FIG. 2.
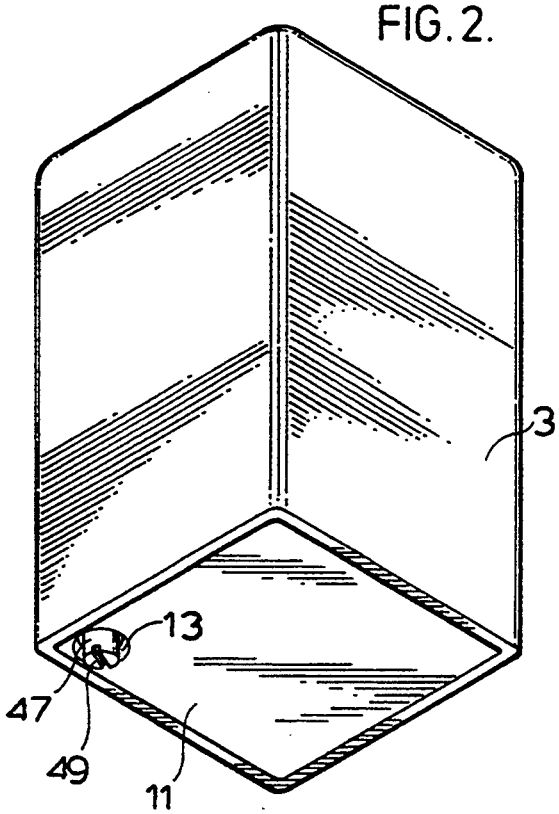
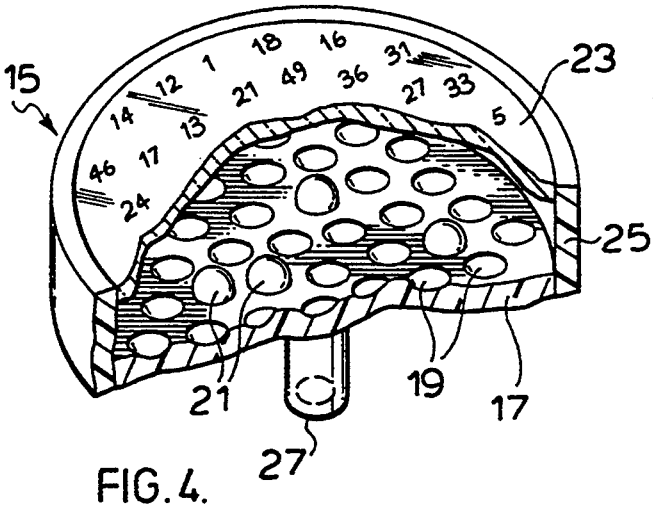
FIG. 4.
FIG. 8.
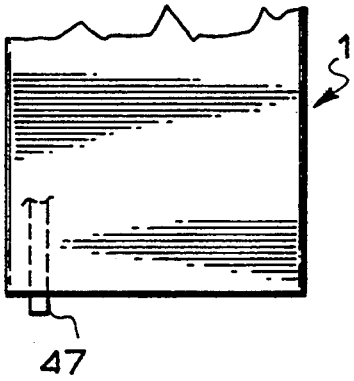
FIG. 7.
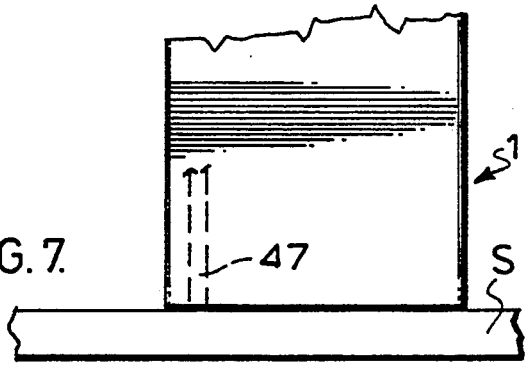

ELECTRICALLY OPERATED RANDOM NUMBER SELECTOR

FIELD OF THE INVENTION

The present invention relates to an electrically operated random number selector having an automatically operating on/off control for operation of the selector.

BACKGROUND OF THE INVENTION

Lotteries are played by literally millions of people. In many lottery formats the numbers, rather than being given, are selected by lottery participants. Some people find this to be a very difficult task and therefore different types of lottery number selection devices have been made available to the market. Most of these devices require manual operation and therefore do not simulate the automatic conditions used in the actual selection of winning lottery numbers.

SUMMARY OF THE INVENTION

The present invention provides an electrically operated random number selector particularly useful for lottery number selections. The selector of the present invention comprises a main housing with a top wall and a number selection turntable assembly mounted at the top wall in the housing. A power source for rotating the turntable assembly is provided within the housing and the housing includes a bottom wall with a power control member at the bottom wall of the housing. The selector, when not in use, seats at its bottom wall on a support surface which holds the power control member in a power off position. When the selector is lifted from the support surface, the power control member is automatically movable to a power on position extending downwardly from the bottom wall of the selector.

The selector of the present invention is both easy and fun to use. Furthermore, there is very little, if any, chance of inadvertently draining the power supply because as soon as the selector is reseated on the support surface, the power control member is automatically moved back to its power off position at the bottom wall of the selector.

BRIEF DESCRIPTION OF THE DRAWINGS

The above as well as other advantages and features of the present invention will be described in greater detail according to the preferred embodiments of the present invention in which;

FIG. 1 is a top perspective view of a random number selector according to a preferred embodiment of the present invention;

FIG. 2 is a bottom perspective view of the random number selector shown in FIG. 1;

FIG. 4 on the first page of the drawings is a partially sectioned perspective view of the turntable assembly from the random number selector of FIG. 1;

FIG. 7, on the first page of drawings, is a simplified sectional view through the lower end of the random number selector of FIG. 1 when seated on its support surface;

FIG. 8, also on the first page of drawings, is a view similar to FIG. 7 with the random number selector lifted from its support surface.

Figure 3:
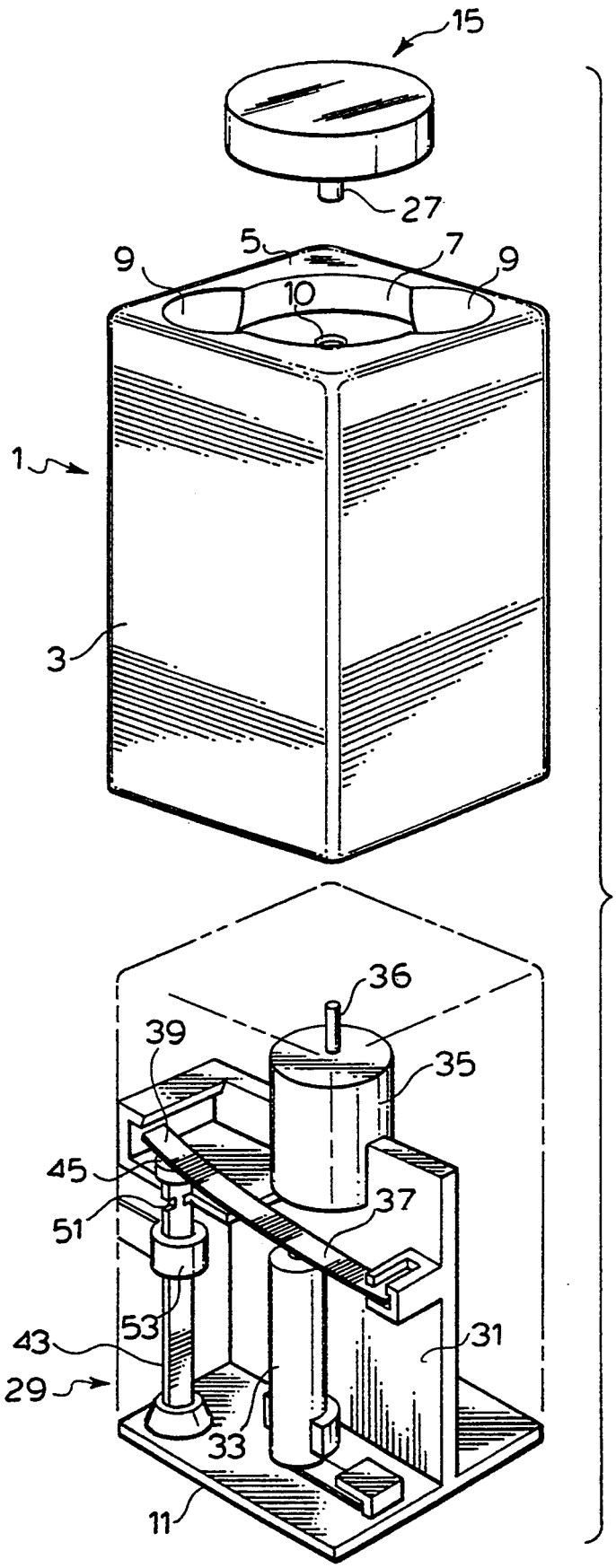
FIG. 3 on the second pages of drawings is an exploded perspective view of the random number selector of FIGS. 1 and 2.

DETAILED DESCRIPTION ACCORDING TO THE PREFERRED EMBODIMENTS OF THE PRESENT INVENTION

FIG. 1 shows an electrically operated random number selector, generally indicated at 1. This random number selector comprises a main housing 3 having a top wall or surface 5 and a bottom wall 11 seen in FIG. 2 of the drawings. A turntable assembly generally indicated at 15 is mounted at the top wall of the housing. The top wall of the housing itself includes a main center generally rounded recess 7 into which the turntable assembly fits and a pair of finger grip recesses 9 to either side of the turntable assembly. Note that for transport purposes, the turntable assembly does not extend upwardly of and is protected by the housing. Furthermore, the housing itself provides a guide for controlled rotation of the turntable assembly as described later in detail.

The finger recesses 9 to either side of the turntable assembly allow it to be removed and replaced with other turntable assemblies. The construction of the other turntable assemblies will be substantially identical to that shown with respect to assembly 15 except that they will be used to select numbers for different lotteries as will again be described later in detail.

Turntable assembly 15 includes a bottom located hollow post 27 which, as to be understood from FIG. 3 of the drawings, fits downwardly through a center opening 10 at the upper end of the housing. The interior construction of the selector generally indicated at 29 includes a series of components supported by the interior frame 31 of the selector. One of these components is an electrically driven motor 35 having an output shaft 36 which fits into the bottom post 27 of the turntable assembly 15. To ensure a non-slip fit between the two, the post and/or the output shaft of the motor can be splined or otherwise connected in an anti-rotation manner relative to one another.

The power supply for the selector is provided by a portable electric battery 33 having a top contact 34. Battery 33 is wired to electric motor 35, as shown, and the electric motor is in turn wired to a second electrical contact 41. A metallic strip 37 operates as a switch for opening and closing the circuit between contacts 34 and 41.

The setup for operating the overall power source includes a power control member generally indicated at 43. This power control member includes an upper end 45 on which the free end 39 of switch 37 is seated. The other end of switch 37 is fixed in position as indicated at 38. The spring-like properties of the metallic strip cause it to constantly push down on the top of control 43 and ensure closure of the circuit when permitted by the control.

The control itself is reciprocable within the housing and slides through a control guide 53. The control terminates with a lower end projection 47 which is exposed at the bottom wall 11 of the housing. The housing bottom wall is additionally provided with an upward recess 12 which helps to allow locking of the control in a power off position as described later in detail.

When the selector is seated on a supporting surface as shown in FIG. 7 of the drawings, the lower end 47 of control 43 is held by the support surface level with the bottom wall 11 of the housing. In this position, the top end 45 of the control 43 pushes the free end 39 of strip 37 up off of contact 41 as indicated by position A shown in FIG. 5 of the drawings. In this position, the electrical circuit is held open without power to motor 35 so that the turntable assembly remains stationary.

In order to electrically operate the turntable assembly, the selector is picked up off the support surface as shown in FIG. 8. The spring bias of strip 37 causes it to push downwardly on control 43 and the lower end 47 of the control is in turn allowed to project downwardly past the bottom wall of the housing because there is nothing now holding it in the up position. Free end 39 of the strip moves downwardly onto contact 41 as indicated by the dotted line position B shown in FIG. 5 where the electrical circuit is closed causing operation of motor 35 to rotate turntable assembly 15.

Figure 5:
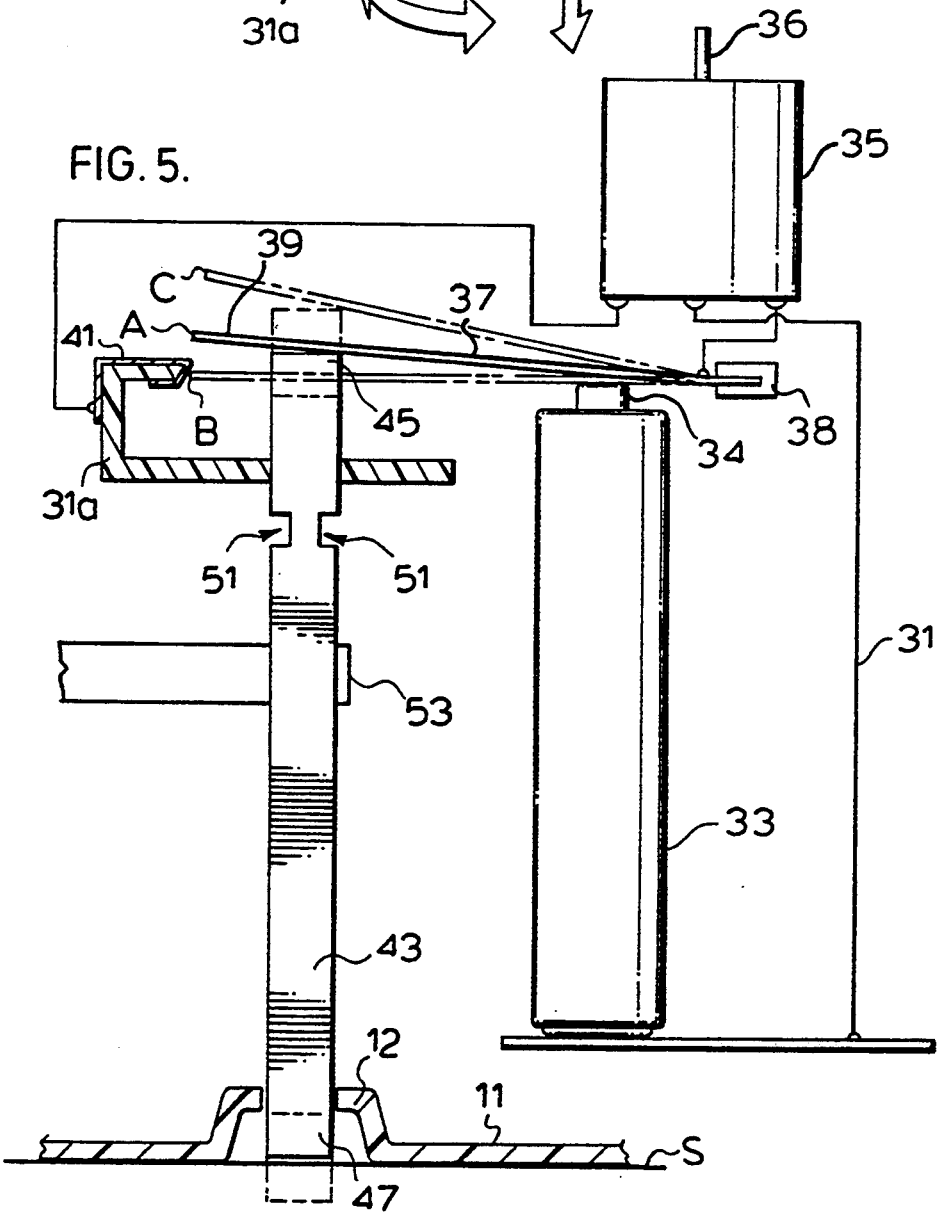
FIG. 5 on the third page of the drawings is a side view of the interior construction of the random number selector of FIG. 3.

As will be appreciated, there will be certain times, such as for example in transporting the selector that it is not desirable to have the battery constantly running and according control 43 is provided with a locking arrangement to hold the metallic strip switch in a locked power off position, i.e. dotted line position C shown in FIG. 5 of the drawings.

Figure 6:
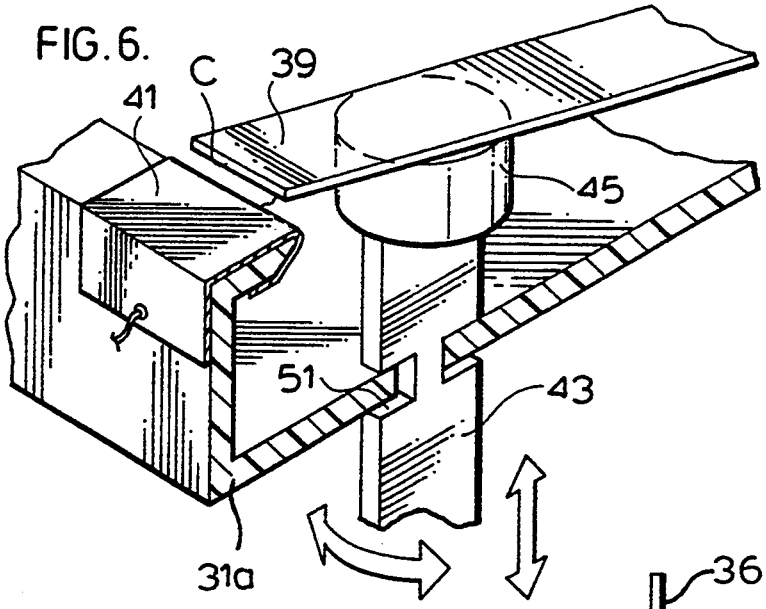
FIG. 6, also on the third page of drawings, is an enlarged perspective view of one of the contact regions for the power source of the random number selector of FIG. 5.

The power off locking arrangement is provided by a pair of recesses 51 on control 43. This control in addition to being reciprocable within the housing is additionally rotatable as indicated in FIG. 6 of the drawings. In order to get to the locked position, control 43 is pushed upwardly at its bottom end 47 into the housing to a point where recesses 51 align with the interior frame portion 31*a* at which point the control is rotated to lock it onto frame portion 31*a*. The upwardly recessed region 12 in the bottom wall 11 of the housing allows a continued access to the bottom end 47 of control 43 in the up locked position. In addition, the bottom end of the control is provided with a slot 49 which allows any type of a flat edged tool to fit into and rotate the control to the locked position. It is however to be appreciated that such a tool is not necessarily required and the control can be easily finger rotated as well.

The turntable assembly provides the means for selection of lottery numbers. As best seen in FIG. 4 of the drawings, this turntable assembly comprises a bottom plate 17 which includes a plurality of depressions or recesses 19. The assembly further includes a transparent window like top wall 23 spaced above the bottom plate 17 by means of a sidewall 25. A plurality of balls 21 are movably trapped within the turntable assembly between bottom plate 17 and top wall 23.

The number of depressions 19 provided in the bottom plate 17 is chosen in accordance with the particular lottery to be played. The same is true for the number of balls which are fewer in number than the depressions. More particularly, in a lottery such as LOTTO 6/49 TM there will be 49 depressions and 6 balls. Each of the depressions is individually marked and in this case, by means of numbers on the top wall placed directly over each depression. The bottom plate 17 and the top wall 23 are always fixed in position relative to one another to ensure proper alignment of the numbers relative to the depressions.

When the turntable assembly is rotated by motor 35, the balls 21 are thrown about in a totally random manner internally of the turntable assembly. When power to the motor is cut off by simply putting the device down on a supporting surface, the turntable will slow down and stop at which point the balls will come to rest again in a totally random manner in some of the depressions as shown in FIG. 7. The numbers over those depressions indicate the numbers to be played by the lottery participant.

As earlier indicated if one wishes to play different lotteries, then various turntable assemblies can be provided. Each turntable assembly will have a specific number of depressions and a specific number of balls peculiar to each lottery.

The electric number selector of the present invention provides a constant source of amusement by simply picking it up, watching it operate and then putting it down to provide different sets of numbers which one may or may not wish to use for lottery play. The operation of the selector is automatic and is therefore similar to the operation of the devices used to make the selection of winning lottery numbers.

The selector can provide many hours of enjoyment with a single electric battery because it is almost impossible to leave the power supply on due to the unique operation of the power supply control.

Although various preferred embodiments of the present invention have been described herein in detail, it will be appreciated by those skilled in the art, that variations may be made thereto without departing from the spirit of the invention or the scope of the appended claims.

Embodiments of the invention in which an exclusive property or privilege is claimed are defined as follows:

1. An electrically operated random number selector comprising a main housing having a base: which sits on a support surface for said selector, a number selection turntable assembly rotatably mounted in said housing, said turntable assembly comprising a plate with a number of marked depressions therein, said plate being covered by a clear cover with said plate being viewable through said cover, and a number of balls moveably trapped between said cover and said plate, the number of depressions in said plate exceeding the number of balls in said turntable assembly, an electrical circuit including a battery and a circuit switch which moves to and away from a circuit closing position in contact with said battery and in which said battery supplies electrical power to and rotates said turntable assembly, and a power control member at said base of said housing, said power control member comprising a vertically moving post which slides between an up position a down position, said circuit being in the circuit closing position when said power control member is in the down position and said power control member holding said circuit switch away from the circuit closing position when said power control member is in the up position.

2. A random number selector as claimed in claim 1 including a downward bias urging said circuit switch to move to the circuit closing position and wherein said housing has a weight sufficiently great to overcome the downward bias on said circuit switch forcing said power control member to lift said circuit switch away from the circuit closing position when said random number selector is seated with said base on its support surface.

3. An electrically operated random number selector comprising a main housing with a bottom wall and a top located number selection turntable assembly mounted in said housing, a power source, which when in a power on position, rotates said turntable assembly and a power control member at said bottom wall of said housing, said power control member being automatically movable when said selector is elevated from a support surface on which said bottom wall is seated and which holds said power control member in a power off position to the power on position extending downwardly from said bottom wall of said selector, said power control member comprising an elongated body which is both axially slideable and rotatable to and from a power off locking position within said housing.

4. An electrically operated random number selector as claimed in claim 3, wherein said power source comprises an electrical circuit with a motor driven by said electrical circuit, said turntable assembly being coupled with said motor, said electrical circuit including a spring biased switch atop said power control member and said switch being held in a circuit open position by said power control member when said selector is seated on the support surface.

5. An electrically operated random number selector as claimed in claim 4, wherein said power control member includes at least one notch and said power control member is rotatable to engage said notch on said housing to lock said power control member against axial sliding within said housing.

* * * * *

UNITED STATES PATENT AND TRADEMARK OFFICE

CERTIFICATE OF CORRECTION

PATENT NO. : 5,435,556

DATED : July 25, 1995

INVENTOR(S) : Richard R. Rice, et al

It is certified that error appears in the above-indentified patent and that said Letters Patent is hereby corrected as shown below:

On the title page, item [73], change "Selections" to --Selectors--.

Signed and Sealed this

Eighth Day of July, 1997

Bruce Lehman

*Attest:*

BRUCE LEHMAN

*Attesting Officer*

*Commissioner of Patents and Trademarks*